US010314332B2

(12) United States Patent
Balder et al.

(10) Patent No.: US 10,314,332 B2
(45) Date of Patent: Jun. 11, 2019

(54) ELECTRONIC VAPING MATERIAL CONTAINER

(71) Applicant: Healthier Choices Management Corp., Hollywood, FL (US)

(72) Inventors: Edwin Balder, Mesa, AZ (US); Gilbert Cyphert, Phoenix, AZ (US); Daniel Julia, Phoenix, AZ (US)

(73) Assignee: Healthier Choices Management, Corp., Hollywood, FL (US)

( * ) Notice: Subject to any disclaimer, the term of this patent is extended or adjusted under 35 U.S.C. 154(b) by 0 days.

(21) Appl. No.: 15/885,614

(22) Filed: Jan. 31, 2018

(65) Prior Publication Data

US 2018/0153209 A1 Jun. 7, 2018

Related U.S. Application Data

(60) Continuation-in-part of application No. 15/832,582, filed on Dec. 5, 2017, now Pat. No. 10,111,461, which is a continuation-in-part of application No. 15/603,263, filed on May 23, 2017, now Pat. No. 9,949,506, which is a division of application No. 13/987,851, filed on Sep. 9, 2013, now Pat. No. 9,687,025.

(60) Provisional application No. 61/743,720, filed on Sep. 10, 2012.

(51) Int. Cl.

| | |
|---|---|
| ***A24F 47/00*** | (2006.01) |
| ***A61M 15/06*** | (2006.01) |
| ***A24F 1/00*** | (2006.01) |

(52) U.S. Cl.
CPC ..... *A24F 1/00* (2013.01); *A24F 47/008* (2013.01)

(58) Field of Classification Search
CPC ..... A24F 47/00; A61M 15/06
See application file for complete search history.

(56) References Cited

U.S. PATENT DOCUMENTS

| | | | | |
|---|---|---|---|---|
| 2008/0023003 | A1* | 1/2008 | Rosenthal | A61M 11/041 128/203.26 |
| 2010/0024834 | A1* | 2/2010 | Oglesby | A24F 47/006 131/194 |
| 2014/0186015 | A1* | 7/2014 | Breiwa, III | A61L 9/03 392/386 |
| 2016/0022930 | A1* | 1/2016 | Greim | A61M 15/06 131/328 |

* cited by examiner

*Primary Examiner* — Cynthia Szewczyk
(74) *Attorney, Agent, or Firm* — Berger Singerman LLP; Geoffrey Lottenberg

(57) ABSTRACT

An inhalant material container for electronic smoking device is a tube-like storage container with an open top and an open bottom. The container is made of quartz, glass, or other like materials. The container has a frangible seal covering the open top and open bottom and may have exterior channels to promote air flow around the container. The container is removably inserted into the heating chamber of an electronic smoking device. The container is easily removed and replaced for on demand use. The container can be used in conjunction with modular electronic cigarettes and vaporizer and their various components and connectors.

18 Claims, 4 Drawing Sheets

ELECTRONIC VAPING MATERIAL CONTAINER

This application is a continuation-in-part of U.S. patent application Ser. No. 15/832,582, filed Dec. 5, 2017, which is a continuation-in-part of U.S. patent application Ser. No. 15/603,263, filed May 23, 2017, which is a divisional of U.S. patent application Ser. No. 13/987,851 filed Sep. 9, 2013, now U.S. Pat. No. 9,687,025, which claims the benefit of U.S. Provisional Application 61/743,720 filed on Sep. 10, 2012.

FIELD OF THE INVENTION

The present invention relates to electronic cigarettes and vaporizers.

BACKGROUND OF THE INVENTION

In an attempt to solve the problems of traditional smoking, electronic cigarettes and vaporizers have come to the forefront. These devices employ the use of a liquid, concentrate, or dry material inhalants that often comprise glycol ad-mixtures, wax-like substances, herbs, flowers, and other medicinal substances. In the conventional art, the inhalant is placed on or otherwise drawn to and over a metal heating element, such as a metal coil, which coil receives electrical energy from an on-board battery. The electrical energy is converted to heat, thereby heating and vaporizing the inhalant material brought in contact with the heating element. The resultant vapor, smoke, or other aerosol is then inhaled by way of a mouthpiece in fluid communication with an air channel disposed through the device.

It is often difficult or simply inconvenient to load a heating chamber of an electronic smoking device with the inhalant material. For example, in some known concentrate and/or dry material heating chambers, the inhalant material has to be manually inserted and/or manually placed onto the heating coils inside the chamber (sometimes known as "dabbing" or "dripping"). These chambers are small and present tight quarters that are difficult or impossible to access for cleaning and can gum up to ill effect. As a result of gumming up, the user often has to scrape or otherwise disturb the inside surfaces of the electronic smoking device to remove spent material and insert new material.

The performance degradation and convenience issues of known vaporizer systems need to be addressed in order to provide a reliable more user-friendly system. The Applicant herein provided a solution to these and other problems as set forth in U.S. patent application Ser. No. 15/832,582, filed Dec. 5, 2017, incorporated herein by reference, which described, among other things, a foil-sealed cup-like container with a closed bottom that is pre-filled or can be filled with inhalant material of any type. The cup device described in Applicant's previous filings offers convenience in delivery of inhalant material and also addressed safety concerns by preventing direct contact between an exposed coil and the inhalant material.

Recognizing that some users prefer the performance characteristics of at least some direct contact between the inhalant material and the heating element (coils), but disfavor the inconvenience of manual "dabbing" or scrapping techniques, the present invention contemplates various embodiments of an open-ended inhalant material container. Accordingly, the present invention is directed at enhancing the convenience, durability, and performance of vaporizer system components.

Figure 1A:
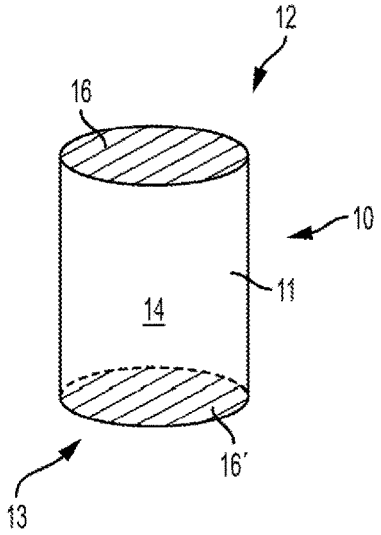
FIG. 1A is a perspective view of the material container.
Figure 1B:
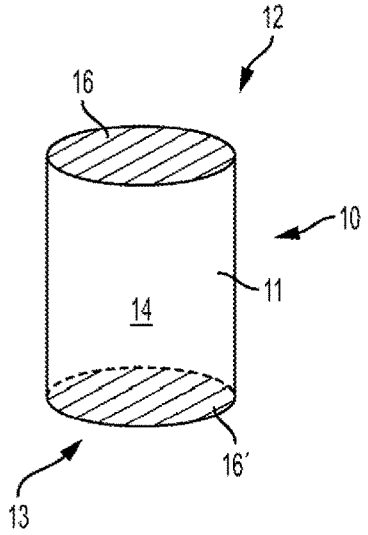
FIG. 1B is a perspective view of the material container with a seals disposed on the otherwise open top and open bottom thereof.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. Throughout this description, the embodiments and examples shown should be considered as exemplars, rather than as limitations. That is, the following description provides examples, and the accompanying drawings show various examples for the purposes of illustration. However, these examples should not be construed in a limiting sense as they are merely intended to provide examples of the invention rather than to provide an exhaustive list of all possible implementations.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "some embodiments" or "one embodiment" or "an embodiment" means that a particular feature, structure or characteristic described in connection with the embodiment is included in at least one embodiment of the present invention. Thus, appearances of the phrases "in some embodiments" or "in an embodiment" in various places throughout this specification are not necessarily all referring to the same embodiment. Furthermore, the particular features, structures or characteristics may be combined in any suitable manner in one or more embodiments.

For purposes of this disclosure, the terms "electronic cigarette" and "vaporizer" are interchangeable and generally refer to an electronic device configured to heat a target inhalant material to be inhaled by the user by mouth. "Inhalant material" for purposes of this disclosure refers to any desired material to be heated and inhaled by way of the electronic cigarette or vaporizer. Such materials include, without limitation, liquids such as glycol-based solutions, semi-solid or solid concentrates such as oils, shatter, and waxes, and dry material such as tobacco, herbs, flowers, and aromatics. The term "vaping" refers generally to the act of using electronic cigarettes and vaporizers for the purposes of generating vapor, smoke, aerosol or other material to be inhaled for pleasure or for the delivery of medicaments or substances to the body; notably, the term is not limited to the act of generating or inhaling only vapor—it refers more broadly to the act of inhaling material by way of electronic devices, as opposed to traditional smoking implements such as cigarettes, pipes, cigars, and the like.

With reference to FIGS. 1A-1D shown is an electronic vaping material container 10. In some embodiments, the container 10 comprises a cylindrical tube-shaped housing 11 having open top 12 and an open bottom 13. The container 10 delimits an internal storage area 14 wherein inhalant material may be placed. In some embodiments, a removable or frangible seal 16 covers and seals the otherwise open top 12 of the container 10 and another removable or frangible seal 16' covers and seals the otherwise open bottom 13 of the container 10. The seals 16 and 16' may comprise a variety of materials such as paper, parchment, foil, or plastic and may be sealed to the container by heat-sealing methods or by an adhesive.

In some embodiments the internal storage area 14 is pre-filled with inhalant material and then the seals 16 and 16' are applied to the open top 12 and open bottom 13, respectively, so that the pre-filled container 10 can be handled and have a shelf life. In other embodiments, the container 10 is provided empty and without seals 16 and 16' for the user to fill manually as desired. In some embodiments, the container 10 is provided with one of the seals 16 or 16' pre-applied and the container 10 or a plurality thereof are disposed in a tray for filling by hand or by machine. Following filling with inhalant material, in some embodiments the second seal 16 or 16' is then applied to seal the container 10 for transport and shelving.

Figure 1C:
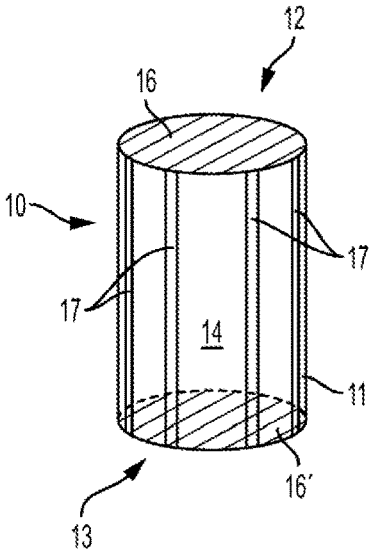
FIG. 1C is a perspective view of the material container shown with vertical air flow channels.
Figure 1D:
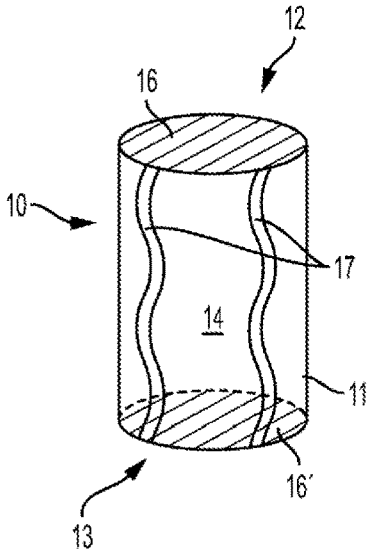
FIG. 1D is a perspective view of the material container shown with curved air flow channels.

In some embodiments, the container 10 includes one or more airflow channels 17 disposed on the exterior of the housing 11 or other appropriate and desired location on the container 10. The channels 17 facilitate airflow on and around the container 10 during use. The channels 17 can vary in size, shape, quantity, and configuration. For example, as shown in FIG. 1C, channels 17 comprise substantially vertical channeling or ribbing, disposed along the length of the housing 11 of the container 10. In other embodiments, the channels 17 of the container 10 may comprise curved channeling, such as in FIG. 1D, or may otherwise comprise a rippling or texturing of the surface of the housing 11. The configuration of channels 17 is not limited to the examples shown in the figures as other designs are possible and equally suitable. The channels 17 may be formed through a molding process or may be generated by an etching, milling, or cutting process. Additionally, in some embodiments, ribbing or texturing may be applied to an interior aspect of the container 10 to promote airflow and to provide better adhesion for the inhalant material to be stored therein.

Figure 5A:
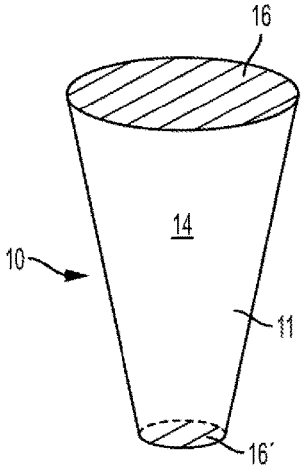
FIG. 5A is a perspective view of yet another embodiment of the material container having a conical shape.
Figure 5B:
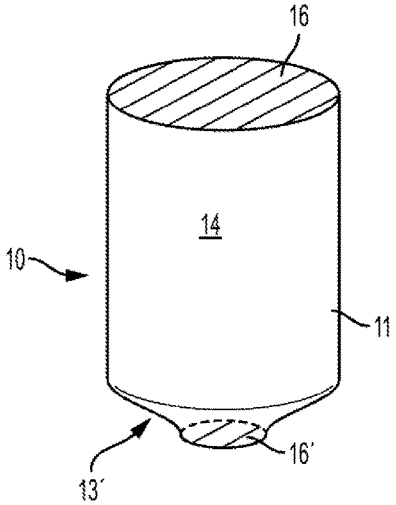
FIG. 5B is a perspective view of yet another embodiment of the material container having a nozzle or funnel-type bottom feature.

The container 10 is configured in various shapes and sizes to accommodate the geometry of the heating chamber of a target electronic smoking device. The housing 11 may vary in shape, size, and configuration and may be cylindrical, conical, square-shaped, and the like. For example, FIG. 5A shows a generally conical container 10. FIG. 5B shows a generally cylindrical container 10 having a nozzle or funnel-type transition 13' integrated into and extending from the open bottom 13 thereof.

In some embodiments, the container 10 comprises a heat-conductive but resilient material such as quartz, glass, silica-containing compositions, semi-precious gems, or any like-performing composition or combinations thereof.

Figure 2A:
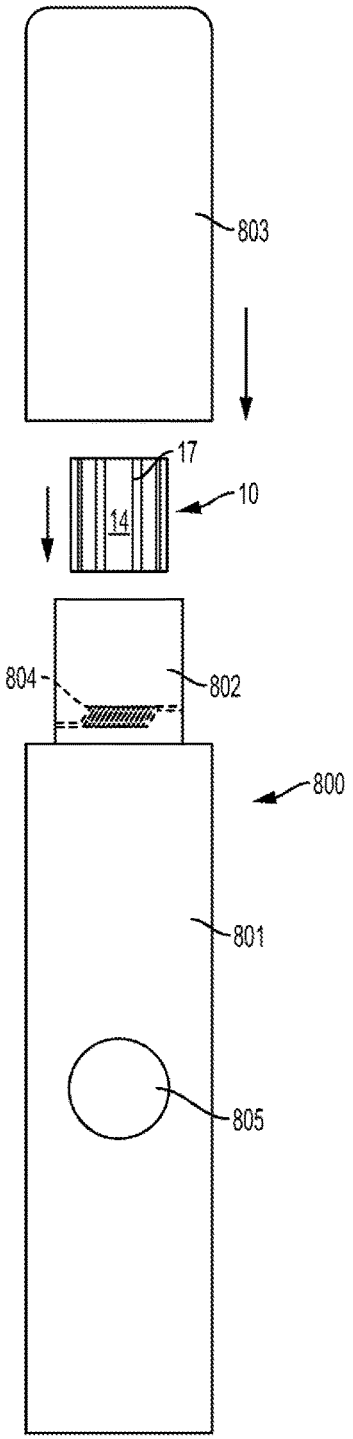
FIG. 2A is an exploded view showing the material container in use with an electronic smoking device.
Figure 2B:
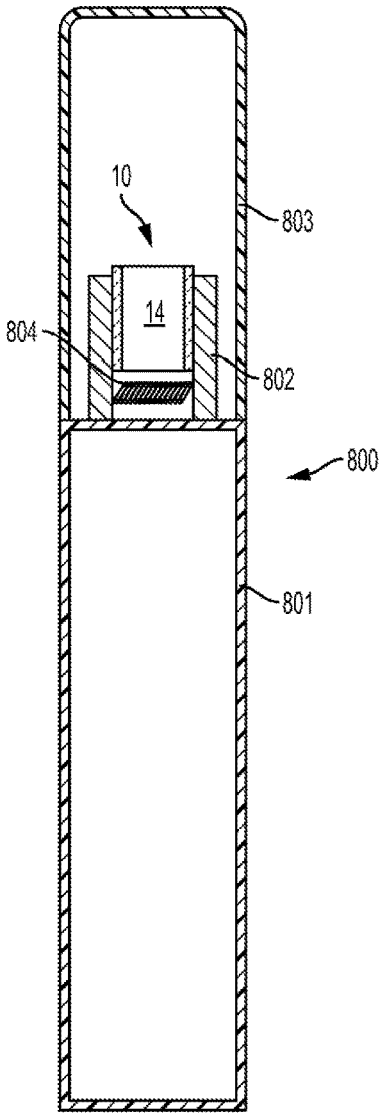
FIG. 2B is a cutaway assembled view showing the material container in use with an electronic smoking device.

The container 10 is designed to be an insertable and removable inhalant material container to be used with a variety of electronic smoking devices. With reference to FIGS. 2A and 2B, shown is the container 10 in use with an exemplary electronic smoking device 800. The configuration of smoking device 800 is for exemplary purposes only, but in this case comprises a "mini-type" vaporizer that includes a control section 801, a heating chamber 802, and a removable mouthpiece 803. The control section 801 comprises a battery and chipset to control the device 800. The heating chamber 802 is an open topped cup-like element and includes a heating element 804, such as a coil or wire, disposed therein. In some embodiments, the heating chamber 802 is removably and threadingly engaged with the control section 801 to provide a physical and electrical connection. In some embodiments, the mouthpiece 803, heating chamber 802 and/or the control section 801 include external apertures and internal air passages to allow for the passage of air through the system in order to draw vapor, smoke, or aerosol there-through.

Traditionally, in these types of units, the inhalant material is to be manually inserted (dabbed, dripped) into the heating chamber 802 such that it comes in direct contact with the heating element 804 and the inside of the heating chamber 802. This manual insertion method is obviated by the more convenient and cleaner container 10. Accordingly, the container 10 is configured and dimensioned to be inserted into and removably retained by the heating chamber 802. In some embodiments, the container 10 fits securely inside the heating chamber 802 by way of an interference fit. The container is inserted such that open bottom 13 of the container 10 is on or adjacent to the heating element 804. In some embodiments, after the container 10 is loaded into the heating chamber 802, the mouthpiece 803 is disposed over the area surrounding the heating chamber 802 and container 10 and snaps onto or is otherwise secured to the control section 801. The seals 16 and 16', if provided, are removed from the container 10 or punctured or broken prior to insertion of the container 10 into the chamber 802, or otherwise prior to closing the device.

In use, the user activates the device 800, typically by a control button 805, which applies electrical current to the heating element 804, which generates heat. Heat generated by the heating element 804 passes through the container 10 and thereby heats the inhalant material held in the internal storage area 14. The inhalant material in some cases will begin to excite within the container 10 and will turn into a vapor, smoke, or aerosol to be inhaled by the user through air passages within the device and out of the mouthpiece 803. In some cases the inhalant material will fall downward onto the heating element 804. When inhalation is applied by the user, air passes through the device 800 components (through the air passages structure therein) and through the channels 17 of the container 10 such that the vapor, smoke, or aerosol is released and pulled out of the open top 12 of the container 10 and through and out of the mouthpiece 803. The vapor, smoke, or aerosol is intended to be delivered to the user's mouth for inhalation. Once the inhalant material has been exhausted from the container 10, the container 10 can be removed and replaced for the next session.

Notably, the use of the container 10 controls the flow of inhalant material to the heating element 804 in order to improve performance and consistency and reduce the amount of residue building up on the heating element 804 and within the heating chamber 802. The container 10 is easily replaced for the next use. The container 10 provides a more convenient means of providing inhalant material to the heating chamber 802 than traditional scraping or "dabbing" techniques.

In some embodiments, the container 10 is configured to be universally compatible with a wide variety of electronic smoking devices and the varied shape and configured heating chambers that such devices implement. Accordingly, the present invention contemplates several embodiments of connectors that can be attached to the container 10 to permit the container 10 to be inserted and retained by a variety of heating chambers and electronic smoking device components. The connectors comprise those connectors disclosed in Applicant's U.S. patent application Ser. No. 15/832,582, filed Dec. 5, 2017, which application is incorporated herein by reference.

Figure 3A:
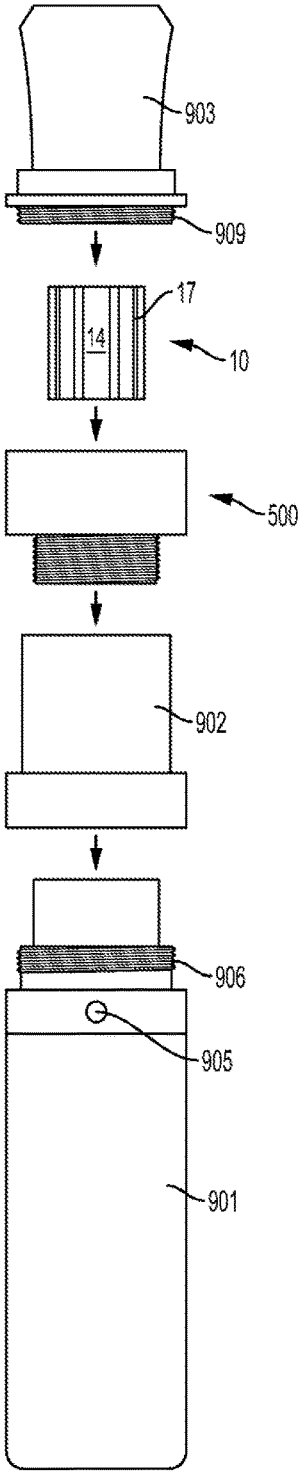
FIG. 3A is an exploded view showing the material container and a connector in use with an electronic smoking device.
Figure 3B:
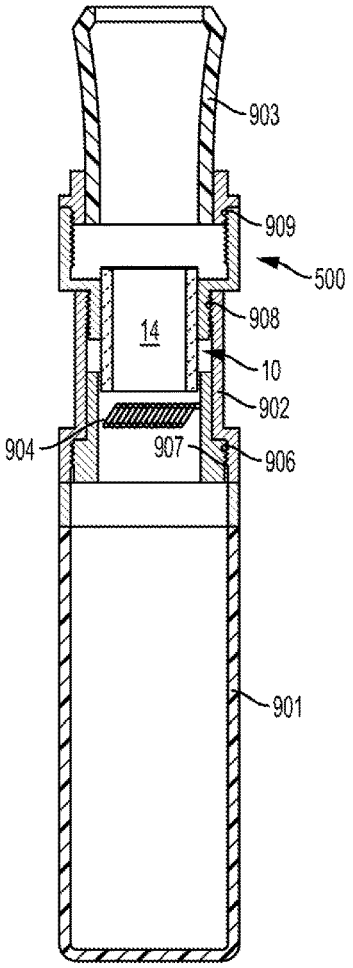
FIG. 3B is a cutaway assembled view showing the material container and a connector in use with an electronic smoking device.

With reference to FIGS. 3A and 3B, shown is the container 10 in use with an exemplary electronic smoking device 900. The configuration smoking device 900 is for exemplary purposes only, but in this case comprises a modular type vaporizer that includes a control section 901, a heating chamber 902, and a mouthpiece 903. The control section 901 comprises a battery and chipset to control the device 900. The heating chamber 902 is a threaded cylindrical device and includes a heating element 904, such as a coil or wire, disposed therein. In some embodiments, the heating chamber 902 is removably and threadingly engaged with the control section 901 to provide a physical and electrical connection. The control section 901 has a male threaded attachment point 906 that engages the internally or female threaded lower attachment point 907 of the chamber 902. The opposite end of the chamber 902, i.e. the upper portion, has an internally or female threaded attachment point 908. In some embodiments, the mouthpiece 903, heating chamber 902 and/or the control section 901 include external apertures and air passages to allow for the passage of air through the system in order to draw vapor, smoke, or aerosol there-through.

Traditionally, in these types of units, the inhalant material is to be manually inserted into the heating chamber 902. In comparison to the mini-type device 800 shown in FIGS. 2A and 2B, the heating chamber 902 of device 900 has a threaded attachment 908 that is traditionally arranged to threadingly receive and attach to the mouthpiece 903, whereas in the device 800 in FIG. 2A, the mouthpiece does not engage the chamber 802, it is disposed over and around it. Accordingly, in order to install the container 10 into the heating chamber 902 and to permit the other components to attach properly, a connector 500 is employed.

The container 10 is configured and dimensioned to be inserted into the female-to-male threaded connector 500 or other like connectors (male-to-male, female-to-female), which connectors are described in detail in the incorporated-by-reference U.S. patent application Ser. No. 15/832,582, filed Dec. 5, 2017. In some embodiments the container 10 is retained in the connector 500 by interference fit. Then the container-loaded connector 500 is inserted into the heating chamber 902 and the male threaded second end 502 is threaded into the female threaded upper attachment point 908 of the chamber 902. Then the mouthpiece 903, which is shown as having male threads 909, is threaded into the female threaded first end 502 of the connector 500. This configuration properly seats the container 10 into the heating chamber 902 with the bottom 13 thereof at or adjacent to the heating coil 904. The seals 16 and 16', if provided, are removed, broken, or punctured prior to or during the closing of the device.

In use, the user activates the device 900, typically by a control button 905, which applies electrical current to the heating element 904, which generates heat. Heat generated by the heating element 904 passes through the container 10 and thereby heats the inhalant material held in the internal storage area 14. The inhalant material then turns into a vapor, smoke, or aerosol to be inhaled by the user through air passages within the device and out of the mouthpiece. Notably, air passes through the device 900 components and through the channels 17 of the container 10 such that the vapor, smoke, or aerosol is released and pulled out of the container 10 and through and out of the mouthpiece 903. Once the inhalant material has be exhausted from the container 10, the container 10 can be unscrewed from the device 900, removed from the connector 500, and replaced for the next session. Notably, the use of the container 10 controls delivery of the inhalant material to the heating element 904 and within the heating chamber 902. The container 10 is easily replaced for the next use.

Figure 4A:
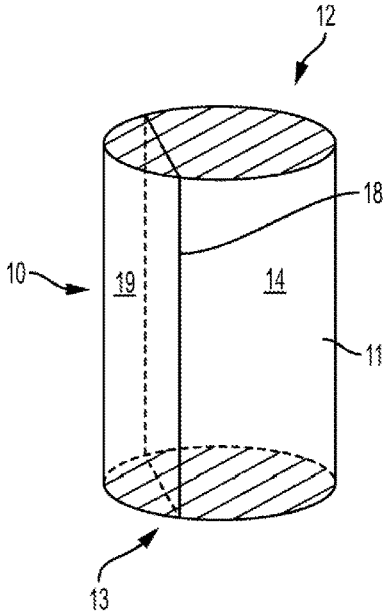
FIG. 4A is a perspective view of another embodiment of the material container.
Figure 4B:
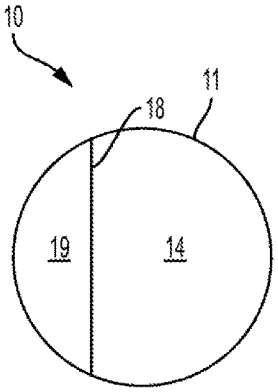
FIG. 4B is a top view of the material container shown in FIG. 4A.

With reference to FIGS. 4A and 4B, shown is another embodiment of the material container 10. In some embodiments, the container 10 comprises a cylindrical tube-shaped housing 11 having open top 12 and an open bottom 13. Disposed inside the container is a partition 18 that divides the interior space of the container 10 to delimit an internal storage area 14 wherein inhalant material may be placed and an internal air passage 19. In some embodiments, removable or frangible seal 16 covers and seals the otherwise open top 12 of the container 10 and another removable or frangible seal 16' covers and seals the otherwise open bottom 13 of the container 10. The seals 16 and 16' may comprise a variety of materials such as paper, parchment, foil, or plastic and may be sealed to the container by heat-sealing methods or by an adhesive.

In some embodiments the internal storage area 14 is pre-filled with inhalant material and then the seals 16 and 16' are applied to the open top 12 and open bottom 13, respectively, so that the pre-filled container 10 can be handled and have a shelf life. In other embodiments, the container 10 is provided empty and without seals 16 and 16' for the user to fill manually as desired. In some embodiments, the container 10 is provided with one of the seals 16 or 16' pre-applied and the container 10 or a plurality thereof are disposed in a tray for filling by hand or by machine. Following filling with inhalant material, in some embodiments the second seal 16 or 16' is then applied to seal the container 10 for transport and shelving.

The internal air passage 19 facilitates airflow through the container 10 and functions similarly to the channels 17 in other embodiments except that the air passes primarily through the container 10 instead of around the exterior thereof. The location and shape of the partition 18 can vary in order to alter the dimensions of the result internal storage area 14 and the internal air passage 19. For example, as shown in FIG. 4B, the partition 18 is offset from the centerline such that the internal storage area 14 is somewhat larger than the internal air passage 19. It is appreciated that in this embodiment airflow primarily passes through the container 10 itself, namely through internal air passage 19, rather than mostly around and about the outside of the container 10 as is the case with the embodiment shown in FIGS. 1A-1D, which include exteriorly-disposed channels 17. In other embodiments, the partition 18 may configured as a concentric internally disposed cylinder inside the container 10 that is offset from the inner wall of the housing 11, providing an air flow passage 19 concentric with the internal storage area 14. Notwithstanding, these two features are not mutually exclusive in that a container 10 could include both the channels 17 and the internal air passage 19 for even greater airflow.

The container 10 shown in FIGS. 4A-4B is configured in various shapes and sizes to accommodate the geometry of the heating chamber of a target electronic smoking device. The housing 11 may vary in shape, size, and configuration and may be cylindrical, conical, square-shaped, and the like. The container 10 comprises a heat-conductive but resilient material such as quartz, glass, silica-containing compositions, semi-precious gems, or any like-performing composition or combinations thereof. The container 10 is designed to be an insertable and removable inhalant material container to be used with a variety of electronic smoking devices substantially as described and shown herein. To that end the container 10 here is equally compatible with the exemplary electronic smoking devices shown in FIGS. 2 and 3, which the airflow passing through internal air passage 19. The container 10 shown in FIGS. 4A-4B can be used in conjunction with various electronic cigarettes and vaporizers including, by way of example only, those shown in FIGS. 2A-2B and 3A-3B, with the airflow and vapor, smoke, or aerosol passing through the internal air passage 19.

FIGS. 5A and 5B depict exemplary embodiments of other embodiments of the container 10 having different geometry. FIG. 5A shows the container 10 have a generally conical shape along with the other features described herein. FIG. 5B shows the container 10 has generally cylindrical and tube-like except for a nozzle or funnel-shaped transition 13' integrated with and extending from the open bottom 13. This transition provides even more control for the passage of inhalant material out of the container 10 during use in conjunction with an electronic smoking device. These embodiments are used substantially in the same manner as described herein with respect to the other embodiments.

It is appreciated and understood that the container 10 controls and in some cases reduces direct contact between the inhalant material and the heating element of the target electronic smoking device, thereby reducing the potentially toxic reaction between the inhalation material and the heating element. The container 10 provides a substantial convenience advantage over the prior art in that the user no longer has to insert manually inhalant material into the cramped quarters of a traditional heating chamber; rather, the user can simply insert and remove on-demand the ready-to-use and easily handled container 10.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise. Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means. The enumerated listing of items does not imply that any or all of the items are mutually exclusive, unless expressly specified otherwise. The terms "a", "an" and "the" mean "one or more", unless expressly specified otherwise. Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An inhalant material container for use with an electronic smoking device, comprising a tube-shaped housing having an open top and an open bottom, the container delimiting an internal storage area wherein the inhalant material is disposed, the inhalant material container removably inserted inside a heating chamber of the electronic smoking device, wherein a heating element inside the heating chamber is disposed adjacent to the internal storage area of the inhalant material container.

2. The inhalant material container of claim 1, comprising a heat conductive and resilient material such as quartz, glass, silica-based materials, semi-precious gems, or combinations thereof.

3. The inhalant material container of claim 1, comprising a frangible seal covering each of the open top and the open bottom of the container.

4. The inhalant material container of claim 1, including at least one airflow channel disposed on an exterior of the container.

5. The inhalant material container of claim 4, wherein the channel comprises a vertical rib.

6. The inhalant material container of claim 4, wherein the channel comprises an etching on the exterior of the container.

7. The inhalant material container of claim 4, wherein the channel comprises a milling on the exterior of the container.

8. The inhalant material container of claim 1, including a funnel-type transition extending from said open bottom.

9. An inhalant material container for use with an electronic smoking device, comprising a tube-shaped housing having an open top and an open bottom, the container delimiting an internal storage area wherein the inhalant material is disposed, the container comprising a heat conductive and resilient material such as quartz, glass, silica-based materials, semi-precious gems, or combinations thereof, the inhalant material container removably inserted inside a heating chamber of the electronic smoking device, wherein a heating element inside the heating chamber is disposed adjacent to the internal storage area of the inhalant material container.

10. The inhalant material container of claim 9, comprising a frangible seal covering each of the open top and the open bottom of the container.

11. The inhalant material container of claim 9, including at least one airflow channel disposed on an exterior of the container.

12. The inhalant material container of claim 11, wherein the channel comprises a vertical rib.

13. The inhalant material container of claim 11, wherein the channel comprises an etching on the exterior of the container.

14. The inhalant material container of claim 11, wherein the channel comprises a milling on the exterior of the container.

15. The inhalant material container of claim 9, including a funnel-type transition extending from said open bottom.

16. An inhalant material container for use with an electronic smoking device, comprising:

a tube-shaped housing having an open top and an open bottom;

a partition disposed inside the housing, the partition delimiting an internal airflow passage and an internal storage area wherein the inhalant material is disposed;

wherein the container comprises a heat conductive and resilient material such as quartz, glass, silica-based materials, semi-precious gems, or combinations thereof; and the inhalant material container removably inserted inside a heating chamber of the electronic smoking device, wherein a heating element inside the heating chamber is disposed adjacent to the internal storage area of the inhalant material container.

17. The inhalant material container of claim 16, comprising a frangible seal covering each of the open top and the open bottom of the container.

18. The inhalant material container of claim 16, including a funnel-type transition extending from said open bottom.

* * * * *